US006560821B2

(12) United States Patent
Miller et al.

(10) Patent No.: US 6,560,821 B2
(45) Date of Patent: May 13, 2003

(54) GLASS DOOR HINGE

(75) Inventors: Craig Miller, Leawood, KS (US); William Liao, Nanking (TW)

(73) Assignee: The Group Legacy L.C., Kansas City, MO (US)

( * ) Notice: Subject to any disclaimer, the term of this patent is extended or adjusted under 35 U.S.C. 154(b) by 86 days.

(21) Appl. No.: 09/780,818

(22) Filed: Feb. 9, 2001

(65) Prior Publication Data

US 2002/0116787 A1 Aug. 29, 2002

(51) Int. Cl.[7] ..... E05D 5/02

(52) U.S. Cl. ..... 16/252; 16/286; 16/334; 16/382

(58) Field of Search ..... 16/292, 293, 334, 16/344, 303, 304, 286, 252, 332, 327, 390, 391, 382; 403/362, 316, 315

(56) References Cited

U.S. PATENT DOCUMENTS

| | | | | |
|---|---|---|---|---|
| 2,681,152 A | * | 6/1954 | Stindt | 210/375 |
| 4,491,355 A | | 1/1985 | Marinoni | |
| 5,079,798 A | | 1/1992 | Burke et al. | |
| 5,297,313 A | | 3/1994 | Brin | |
| 5,513,420 A | | 5/1996 | Kennedy | |
| 5,613,276 A | * | 3/1997 | Franz | 16/229 |
| 5,867,869 A | * | 2/1999 | Garrett et al. | 16/252 |
| 5,909,980 A | * | 6/1999 | Holdsworth | 403/265 |
| 6,070,294 A | * | 6/2000 | Perkins et al. | 16/250 |

FOREIGN PATENT DOCUMENTS

| | | |
|---|---|---|
| DE | 1965603 | 5/1969 |
| DE | 1965604 | 5/1969 |
| DE | 24 32 158 | 1/1976 |
| DE | 27 39 939 | 3/1979 |
| DE | 27 48 623 | 5/1979 |
| FR | 2342392 | 9/1977 |
| GB | 404854 | 1/1934 |

OTHER PUBLICATIONS

Copies of C.R. Laurence Company Catalog No. SD01, Published 2000 (with attention to p. 21).

Copies of C.R. Laurence Company Catalog No. SD03, Published 2001 (with attention to p. 23).

* cited by examiner

*Primary Examiner*—Anthony Knight
*Assistant Examiner*—Enoch E Peavey
(74) *Attorney, Agent, or Firm*—Hovey Williams LLP

(57) ABSTRACT

A glass door hinge is provided which is self-centering and clamps a glass door between two opposed clamps. The hinge includes a mount, a pair of clamps, a hinge block, a spindle, and a biasing member for engaging the spindle to return the clamps and the door to a centered position. Each of the clamps is preferably provided with a lipped gasket which isolates the door from the metal hinge components. One of the clamps has a pair of set screws for holding the spindle in position relative to the clamps, and a pair of locking screws for inhibiting movement of the set screws. The set screws and locking screws are concealed from view by being received entirely within the clamp.

11 Claims, 2 Drawing Sheets

GLASS DOOR HINGE

BACKGROUND OF THE INVENTION

1. Field of the Invention

The present invention is broadly concerned with hinges for glass doors. More particularly, it is concerned with a hinge having improved stability and isolation of the glass from the hinge element.

2. Description of the Prior Art

Hinges of various types for permitting doors to swing about an axis are well known. One particular application for such hinges is on glass doors of the types used for bath and shower stalls and the like. Such applications place particular demands on the hinge due to the weight of the door and the generally brittle character of glass. Moreover, the use of glass necessitates the provision of an attractive hinge, and must be moisture resistant in light of the often moist and humid environment in which it may often be required to operate.

On particular hinge device which has been developed for use on a glass door or panel is shown in U.S. Pat. No. 5,867,869. This type of hinge uses pressure on a main pivot roller by a sub pin roller in order to return the swinging door to a desired orientation. However, the hinge shown in this design is subject to fatigue from repeated cycling of use, whereby the hinge may loosen. Moreover, while gaskets are designed to be positioned between the glass and the metal in order to avoid damage to the glass, the glass may nevertheless contact the metal hinge components after repeated use or during installation.

Thus, a need for an improved glass door hinge which overcomes these and other problems has developed.

SUMMARY OF THE INVENTION

The present invention addresses these problems by improving the ability of the hinge to maintain correct alignment over a large number of cycles of use, and by facilitating the task of the installer in regard to isolating the glass door from the metal components of the hinge. The glass door hinge hereof particularly addresses these needs while providing an attractive appearance by the use of locking screws to hold set screws which engage complementally shaped countersunk indentations in the spindle to resist slippage of the spindle relative to the hinge block in which it is received, by providing a lipped gasket to maintain isolation of the glass from the metal clamp for the door or panel, by providing a groove in the spindle for receiving and retaining lubricant over a large number of cycles.

Broadly speaking, the glass door hinge hereof includes a pair of opposed clamps which receive therebetween a glass door. A pair of specially configured lipped gaskets of flexible elastomeric material are placed between the glass door and the clamps to isolate the glass door from the clamps. The clamps also receive therebetween a spindle which is maintained stationary relative to the clamps by a first pair of set screws which are in turn locked into place by a pair of backing screws. The clamps and the spindle thus pivot with the door relative to a hinge block. The hinge block is coupled by fasteners to a hinge mount to maintain a fixed relationship thereto, whereby the spindle pivots relative to the block and defines the door pivot axis. The hinge block includes at least one centering member biased by a spring against a face of the spindle. The spring is held between the mount and the centering member in order to exert a force against the spindle face which serves to urge the door to a desired initial orientation relative to the mount. The mount may be a wall mount or, alternative, a second set of glass clamps and lipped gaskets to couple the glass door hinge to a panel, such as a glass panel.

The glass door hinge hereof greatly facilitates installation of the door to a wall or adjacent panel. The lipped gaskets may be positioned on the clamps to prevent contact between the metal clamps including around the boss during assembly and adjustment of the positioning of the door during installation. Once installed, the locking screws and the set screws are completely concealed from view, the set screws engaging the spindle at countersunk indentations, but together inhibit movement of the spindle relative to the clamps notwithstanding repeated cycles of usage.

These and other advantages of the present invention will be readily apparent to those skilled in the art with reference to the drawings and description which follow.

DESCRIPTION OF THE PREFERRED EMBODIMENT

Figure 1:
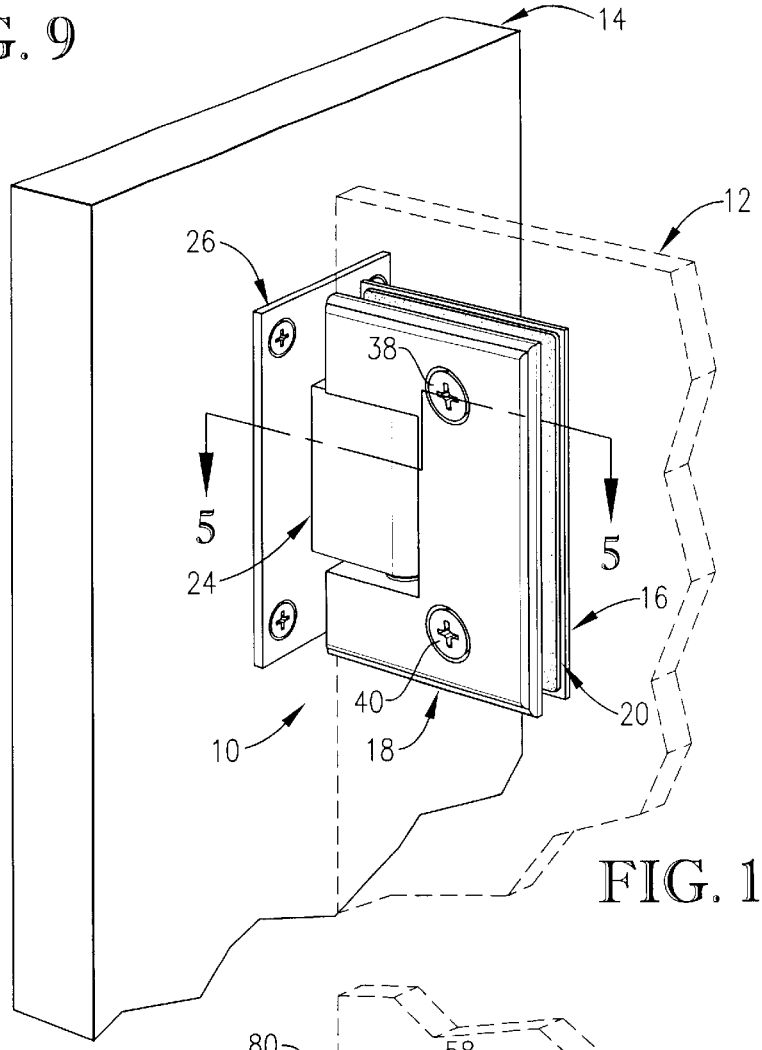
FIG. 1 is a right front perspective view of a glass door hinge in accordance with the present invention showing a door in broken lines with the opposed clamps receiving the door therebetween and the mount coupled by threaded fasteners to a supporting wall.
Figure 4:
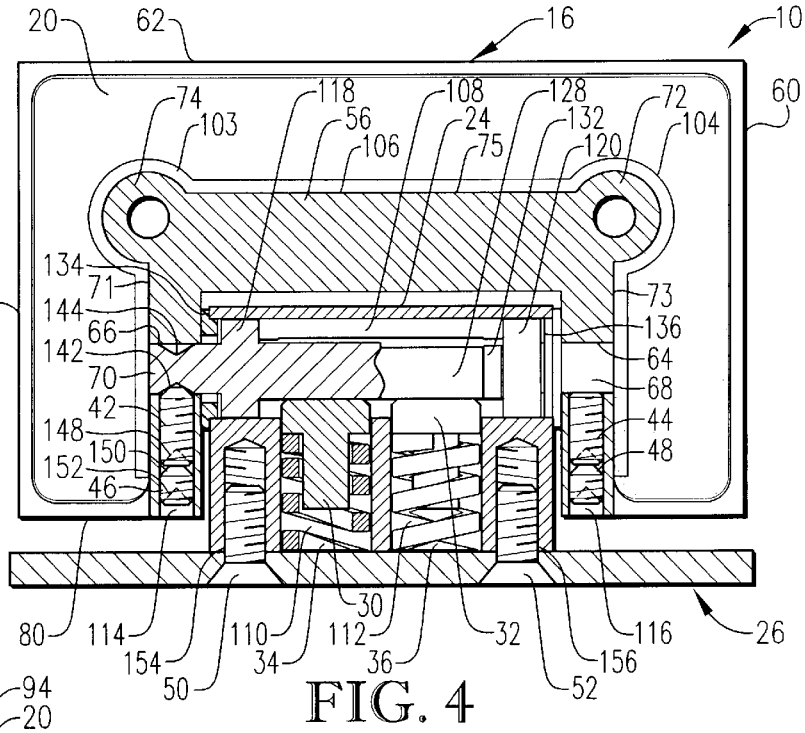
FIG. 4 is a vertical view of glass door hinge hereof shown in a horizontal orientation in partial cross section through the part of the spindle, hinge block, one of the door clamps, mount and one of the centering members, the hinge being in the centered position.
Figure 5:
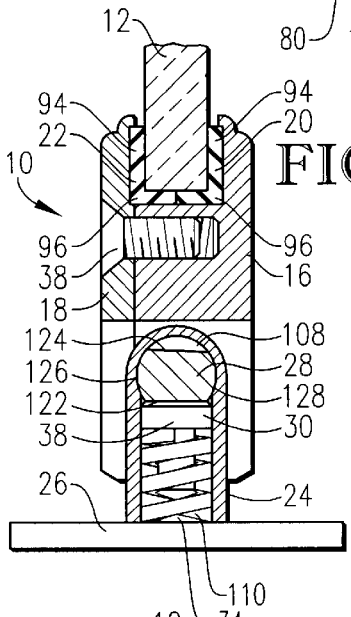
FIG. 5 is a horizontal cross-sectional view through the hinge hereof, showing the positioning of the lipped gaskets isolating the door from the door clamps and the door in a centered position.
Figure 6:
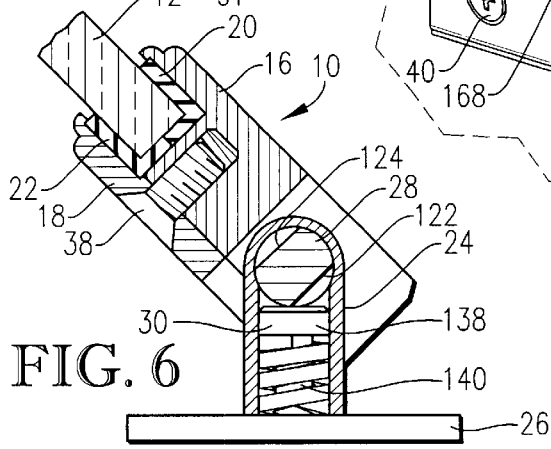
FIG. 6 is a horizontal cross-sectional view similar to FIG. 5, showing the door and hinge pivoted about the spindle from the centered position.

Referring now to the drawings, the descriptions of which refer to a door mounted for pivoting about a generally vertical axis, a glass door hinge 10 in accordance with the present invention is adapted for pivotally mounting a door 12, and in particular a glass door, to a supporting structure such as wall 14. The hinge 10 as shown in FIG. 1 broadly includes a pair of opposed first and second clamps 16 and 18, a respective pair of lipped gaskets 20 and 22 for receipt between the clamps and the door 12, a hinge block 24, and a mount 26. As shown in FIG. 4, the hinge 10 further includes a spindle 28, a pair of centering members 30 and 32 biased by respective springs 34 and 36, clamp screws 38 and 40 (shown in FIG. 1), set screws 42 and 44, locking screws 46 and 48, and mount screws 50 and 52 for coupling the mount to the hinge block 24.

Figure 3:
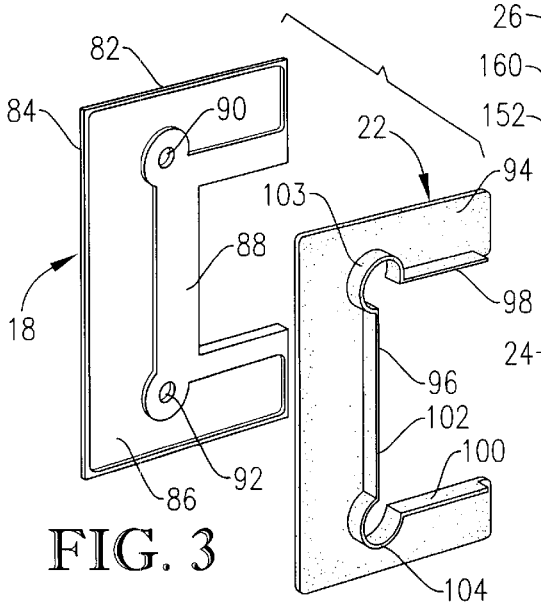
FIG. 3 is a fragmentary perspective view of the door clamp opposite the clamp shown in FIG. 2, showing the configuration of the clamp and the lipped gasket lying normally adjacent thereto.
Figure 2:
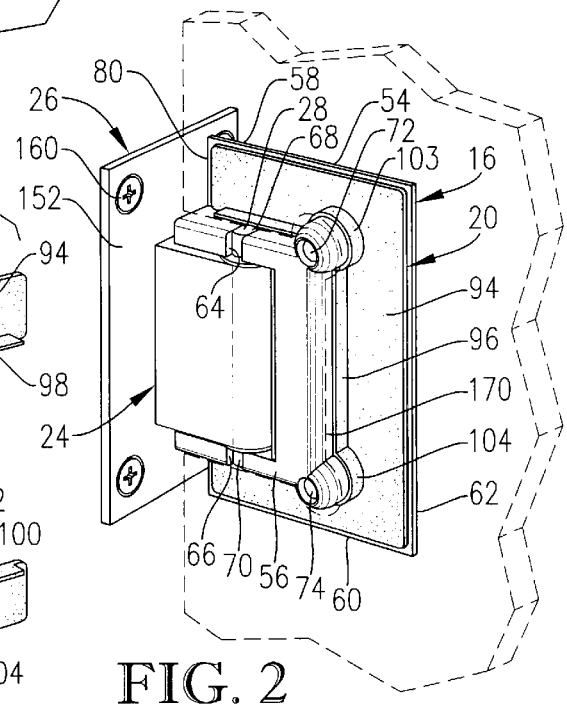
FIG. 2 is a right front perspective view similar to FIG. 1 showing one of the opposed clamps removed to show one of the two lipped gaskets in position to isolate the door from the metal hinge clamps, hinge block and fasteners holding the clamps together.
Figure 7:
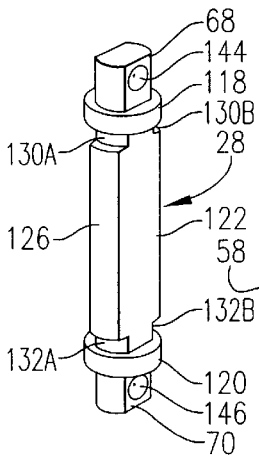
FIG. 7 is a perspective view of the spindle.

In greater detail, first clamp 16 is seen in FIG. 2 and includes a substantially U-shaped plate 54 with a recess for receiving therein lipped gasket 20. The plate 54 further includes a raised and inwardly projecting boss 56 positioned in spaced relationship to the upper margin 58, lower margin 60 and remote margin 62 of the plate 54. The boss 56 has an upper notch 64 and a lower notch 66 in vertical registry therewith to receive respective ears 68 and 70 of spindle 28 therein. The boss 56 is substantially U shaped, being open proximately and thus toward a proximate margin 80 of the plate 54. The boss 56 has an upwardly facing edge 71 oriented toward the upper margin 58, a lower facing edge 73 oriented toward the lower margin 60, and a remotely facing edge 75 oriented toward the remote margin 62. The boss 56 also includes lobes providing a pair of internally threaded clamp screw receivers 72 and 74 at the corners of the U shaped portion so as to be positioned relatively remotely (away from the mount 26) from the notches 64 and 66 which receive therein clamp screws 38 and 40, respectively. The boss 56 further includes two parallel, spaced-apart, internally threaded holes 114 and 116 extending from the proximate margin 80 of the plate toward the notches 64 and 66, respectively for receiving therein the set screws and locking screws. Clamp 18 includes a plate 82 which has an outer margin 84 which is a mirror image of the margin of the clamp 16, and includes a recess 86 for receiving lipped gasket 22 and a boss 88 which is opposed to, mates against and substantially mirrors the boss 56, but unlike boss 56, is not raised relative to the outer margin 84 to thereby project toward the opposite clamp to have any greater relief than the margin 84 as may be seen from FIG. 3. Two clamp screw passages 90 and 92 are provided for permitting clamp screws 38 and 40 to pass through the clamp 18 and thread into the receivers 72 and 74 which are aligned therewith. The clamps are typically machined of metal such as brass, and may receive thereon a plating of other metal or alloy such as chromium or stainless steel, if desired.

The lipped gaskets 20 and 22 are best seen in FIGS. 3, 4, 5 and 6, each being unitary and of a flexible, elastomeric material such as polyurethane or synthetic rubber to absorb any shock or force concentrations which would otherwise be transmitted to the glass door 12 by the clamps 16 and 18, or the spindle 28. The lipped gaskets 20 and 22 are substantially mirror images of one another, each including a flat section 94 configured complementary with the clamps 16 and 18 so as to be received in the recess 80 of the clamps and abut the boss 56 or boss 88, and a lip 96, extending around the lobes of the receivers 72 and 74. The lip 96 is configured with upper and lower walls 98 and 100 which are spaced apart and located in substantially parallel planes to one another, a substantially flat outer wall 102 oriented substantially perpendicular to the walls 98 and 100, and arcuate corner sections 102 and 104 configured to wrap around the receivers 72 and 74. The lips 96 of each of the gaskets 20 and 22 are sized to extend about half way between the plates 54 and 82 and therefore meet around the outer edge 106 of the boss 56.

The hinge block 24 is machined of a single piece of metal, such as brass, and like the plates, may receive a plating of other metal or alloy. The hinge block 24 as illustrated is substantially rectangular having a vertical bore 108 for receiving the spindle 28 therein. Further, it includes two parallel, spaced-apart horizontal bores 110 and 112 oriented perpendicular to the vertical bore 102 for receiving the centering members 30 and 32 and their respective springs 34 and 36. Internally threaded chambers 114 and 116 are positioned above and below the horizontal bores 110 and 112 to receive the mount screws 50 and 52.

The spindle 28 is elongated and preferably made of a relatively wear-resistant metal such as steel and has ears 68 and 70 at each respective end, circular shoulders 118 and 120 inwardly of the ears, and a pair of substantially flat centering surfaces 122 and 124. One of the centering surfaces, such as surface 122, is preferably parallel to the plane of the faces of the ears 68 and 70 so that the door 12 will be centered substantially perpendicular to the mount 26. The surfaces 122 and 124 are preferably not parallel to one another, but rather lie along intersecting planes at an angle to one another to permit the spindle to be reversed and thereby provide two different angular orientations for the centered position of the door 12 relative to the mount. The angle may be any desired angle up to about 90°, but in practice an angle of 5° to about 45° is most useful. Rounded bearing surfaces 126 and 128 separate the centering surfaces 122 and 124 and engage both the hinge block 24 and the centering members 30 and 32 when the door 12 is pivoted. Arcuate lubricant grooves 130 and 132 are positioned relatively below and above the shoulders 118 and 120 and in the bearing surfaces 126 and 128 adjacent the centering surfaces for receiving therein a quantity of lubricant, such as lithium grease or the like. The lubricant grooves act as a reservoir to retain the lubricant adjacent the shoulders 118 and 120 and the bearing surfaces, each of which which bear against the hinge block 24. Plastic washers 134 and 136 are preferably placed as shown in FIG. 4 to inhibit the entry of dirt and moisture into the bore 108.

The centering members 30 and 32 are preferably small metal buttons preferably of stainless steel which have a head 138 with rounded edges and sized to be received in the horizontal bores 110 and 112, and a shank 140 to receive the springs 34 and 36 therearound. The springs 34 and 36 are preferably steel die springs having flattened surfaces which meet when compressed to permit greater spring strength in a limited space.

The set screws 42 and 44 each have conical tips 142 to facilitate location and retention in complemental conical indentations 144 and 146 in the face of the ears 68 and 70. Furthermore, the set screws 42 and 44 include hexagonal shaped recesses in their back ends 148 opposite the tips 142 to receive an allen wrench therein. Further, the hexagonal recesses facilitate entry of conical points 150 of the locking screws 46 and 48, which also include hexagonal shaped recesses in their back ends 152 for receiving an allen wrench. The set screws are initially tightened by the allen wrench against the ears of the spindle 28, and then the locking screws are tightened against the set screws also by an allen wrench, such that both the set screws and the locking screws are completely hidden as shown in FIG. 4.

Figure 9:
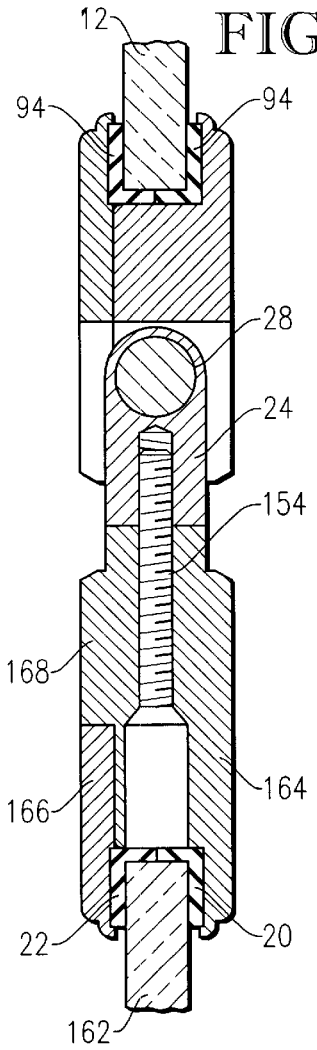
FIG. 9 is a horizontal sectional view of the embodiment of the glass door hinge shown in FIG. 8, showing the mount with additional lipped gaskets in clamping relationship to an upright vertical panel.
Figure 8:
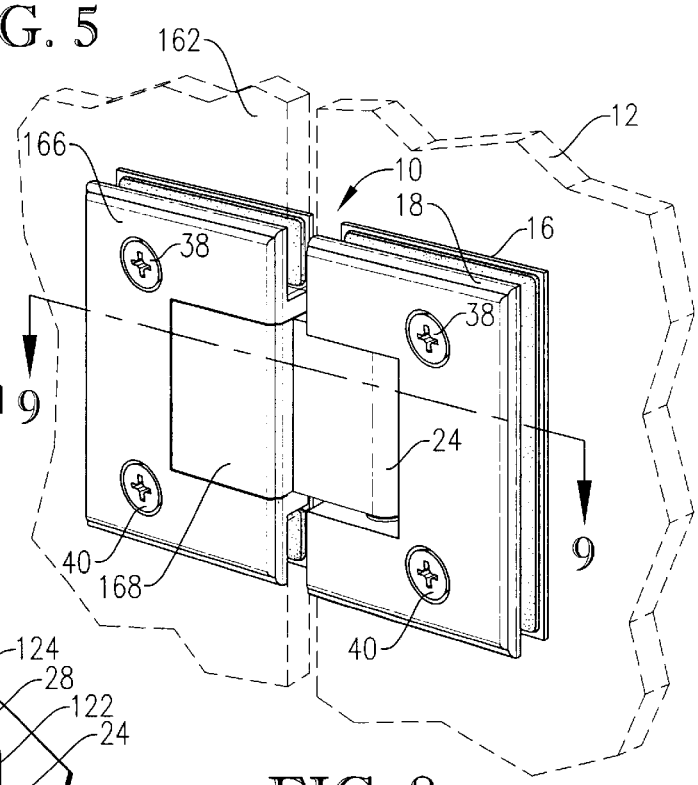
FIG. 8 is a perspective view of a second embodiment of the hinge hereof wherein the mount is provided for clamping to a panel.

The mount 24 as shown in FIGS. 1 through 7 is a simple wall mount plate 154 having two center countersunk holes 156 and 158 for receiving therethrough mount screws 50 and 52, and four outer countersunk holes 160 for receiving wall mounting screws for attachment to a stud or other sturdy structural member. Alternatively, as shown in FIGS. 8 and 9, mount 24 may be provided for coupling to an adjacent flat panel 162, such as one made of glass, by clamps 164 and 166. The clamp 164 is configured similarly to clamp 16, but instead of boss 56 has a solid central block portion 168 without notches, and the countersunk holes are of substantially greater length to accommodate the central block portion and the mount screws are of greater length to pass therethrough and thread into the hinge block 24. The clamp 166 is the same configuration as clamp 18. Lipped gaskets 20 and 22 are placed between the clamps 164 and 166 and the glass, and clamp screws 38 and 40 hold the panel 162 between the clamps 164 and 166.

The glass door 12, as well as panel 162 if employed, are provided with at least a pair of cutouts 170 complementally configured to receive the hinge 10 hereof so that the lipped gaskets 20 and 22 are positioned between the clamps 16 and 18 or 164 and 166. The configuration of the cutout 170 is generally shown by the broken line in FIG. 2.

When the hinge 10 hereof is assembled, lubrication is placed in the lubricant grooves 130 and 132 and the spindle 28 is placed in the vertical bore 108 of the hinge block 24, after which the plastic washers 134 and 136 are fitted over the ears and help to hold the spindle in place. The centering members 30 and 32 and their associated springs 34 and 36 are placed in the horizontal bores 110 and 112, and the springs are compressed when the plate 154 is attached to the hinge block 24 by threading the mount screws 50 and 52 into the chambers 114 and 116. The spindle is then oriented in the desired position and the clamp 16 attached to the spindle so that the flat surfaces of the ears 68 and 78 are held by the notches 64 and 66. The notches 64 and 66 are sized to prevent turning of the spindle relative to the clamps 16 and 18 when coupled together. The set screws are then turned inside their holes 76 and 78 and tightened against the ears 68 and 70 of the spindle to prevent misalignment of the spindle 28 relative to the hinge block 24. Further, the locking screws 46 and 48 are tightened against the set screws 42 and 44 to prevent the set screws from loosening during repeated cycles of use, the locking screws being positioned entirely within their holes 76 and 78. The great weight and corresponding moment caused by the cantilevered mounting of the glass door 12 on the hinge would otherwise loosen the set screws and cause the spindle to loosen because of the self-closing design. As noted above, the spindle 28 may be oriented to position either centering surface 122 or 124 toward the centering members 30 and 32 so that the door 12 may have an initial, centered position either perpendicular to the plane within which wall plate 154 lies, or at another, different angle with respect thereto determined by the angular relationship of the surface 124 relative to the ears 68 and 70.

The hinge 10 is normally provided preassembled to the installer. Holes are drilled in the stud or other structural member of the wall if the wall mount plate 154 is employed, using the holes 160 to mark their location. The lipped gaskets 20 and 22 are preferably provided glued in place on their respective clamps 16 and 18. The clamp screws 38 and 40 are temporarily removed to temporarily separate clamp 18 from the clamp 16. Thereafter, the lipped gasket 20 may be inserted into the cutout 170 of the glass door. The use of the lipped gasket 20 greatly facilitates the task of the installer by providing positive separation between the metal hinge clamps and the glass and aiding alignment. Once properly aligned, the other clamp 18 with its corresponding lipped gasket may be placed on the opposite side of the glass door and attached by passing the clamp screws 38 and 40 through the passages 90 and 92 and threading them into the receivers 72 and 74. The plate 154 may then be mounted to the wall by wall mount screws as shown in FIG. 1. Alternatively, the plate 154 of each hinge 10 may be mounted to the wall 14 prior to attachment of the glass door 12, and then the glass door 12 placed around the lipped gasket 20 and the second clamp 18 and lipped gasket 22 attached as described above. When mounting the hinge 10 to a panel 162 by clamps 164 and 166, the hinge block 24 is attached to the clamp 164 as described with reference to the plate 154 above, and then either the door 12 or panel 162 attached to the hinge as described with reference to the glass panel 12 as set forth above, followed by attachment to the other of the glass door or panel 162, being careful to ensure the placement of the lipped gaskets between the glass and the clamps.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the literal scope of the invention as set out in the following claims.

What is claimed is:

1. A glass door hinge for pivotally mounting a glass door to an adjacent supporting member comprising:

first and second opposed clamps adapted for receiving there between a glass door, at least one of said clamps including a plate and also including a boss extending toward the other of said clamps;

a spindle received between said clamps against movement relative thereto and defining a pivot axis of the hinge, said spindle having a pair of circumferentially spaced centering surfaces separated by arcuate bearing surfaces, and including a groove in at least one of said arcuate bearing surfaces adapted for receiving lubricant therein;

a mount for coupling to a supporting member;

a hinge block fixedly coupled to the mount and pivotally receiving said spindle therein;

a centering member biased against the centering surface of the spindle when the clamps are in a centered position;

a pair of set fasteners received by one of said clamps and engaging said spindle to inhibit relative movement between said spindle and said one clamp; and a pair of locking fasteners received by said one of said clamps and engaging said set fasteners for inhibiting movement of said set fastener.

2. A glass door hinge for pivotally mounting a glass door to an adjacent supporting member comprising:

first and second opposed clamps adapted for receiving therebetween a glass door, each of said clamps including a plate having an inwardly facing surface and at least one of said clamps having a raised boss extending toward the other of said clamps to present a remotely facing edge;

a spindle received between said clamps against movement relative thereto and defining a pivot axis of the hinge, said spindle having at least one centering surface;

a mount for coupling to a supporting member;

a hinge block fixedly coupled to the mount and pivotally receiving said spindle therein;

a centering member biased against the centering surface of the spindle when the clamps are in a centered position; and at least one gasket received on the inwardly facing surface of at least one of said plates, said gasket including a substantially flat section and a raised lip angularly oriented relative to said flat section and extending toward the opposite clamp in substantially overlying relationship to said remotely facing edge.

3. A glass door hinge as set forth in claim 2, including a second gasket on the other of said plates, said second gasket including a substantially flat section and a raised lip angularly oriented relative to said flat section and extending toward the lip of said one gasket, the lips of said one and said second gasket cooperatively substantially covering said remotely facing edge.

4. A glass door hinge as set forth in claim 3, wherein the boss has an upper edge an lower edge, the lips of said one gasket and said second gasket cooperatively substantially covering said upper edge and said lower edge.

5. A glass door hinge as set forth in claim 4, herein said boss is substantially U-shaped and includes a pair of lobes adjacent the remotely facing edge.

6. A glass door hinge as set forth in claim 5, wherein said lips of said one and said second gaskets substantially cover said lobes.

7. A glass door hinge as set forth in claim 6, wherein said one gasket and said second gasket are polyurethane.

8. A glass door hinge as set forth in claim 6, including pair of set fasteners received by one of said clamps and engaging said spindle to inhibit relative movement between said spindle and said one clamp and a pair of locking fasteners received by said one of said clamps and engaging said set fasteners for inhibiting movement of said set fastener.

9. A glass door hinge for pivotally mounting a glass door to an adjacent supporting member comprising:

first and second opposed clamps adapted for receiving therebetween a glass door, at least one of said clamps including a plate and also including a boss extending toward the other of said clamps;

a spindle received between said clamps against movement relative thereto and defining a pivot axis of the hinge, said spindle having at least one centering surface and an arcuate bearing surface circumferentially adjacent said centering surface, said arcuate bearing surface including a groove therein adapted for receiving lubricant;

a mount for coupling to a supporting member;

a hinge block fixedly coupled to the mount and pivotally receiving said spindle therein; and a centering member biased against the centering surface of the spindle when the clamps are in a centered position.

10. A glass door hinge as set forth in claim 9, wherein said spindle includes first and second circumferentially spaced centering surfaces and first and second arcuate bearing surfaces located circumferentially intermediate said first and second centering surfaces, each of said bearing surfaces including a respective groove therein communicating with each of said centering surfaces.

11. A glass door hinge as set forth in claim 10, wherein said spindle is elongated and includes a first and second longitudinally spaced circular shoulders and third and fourth grooves, said grooves being arcuate, said first and second grooves being positioned longitudinally intermediate said first circular shoulder and respectively said first and second bearing surfaces and said third and fourth grooves being positioned longitudinally intermediate said second shoulder and respectively said first and second bearing surfaces.

* * * * *